US006819034B1

(12) United States Patent
Pavlovsky

(10) Patent No.: US 6,819,034 B1
(45) Date of Patent: Nov. 16, 2004

(54) CARBON FLAKE COLD CATHODE

(75) Inventor: Igor Pavlovsky, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 266 days.

(21) Appl. No.: 09/642,955

(22) Filed: Aug. 21, 2000

(51) Int. Cl.[7] ..... H01J 1/30
(52) U.S. Cl. ..... 313/311; 313/495
(58) Field of Search ..... 313/309, 310, 313/311, 336, 351, 355, 495, 496, 497; 445/50, 51, 24, 25; 315/169.7

(56) References Cited

U.S. PATENT DOCUMENTS

| | | | | |
|---|---|---|---|---|
| 3,866,077 A | | 2/1975 | Baker et al. | |
| 4,272,699 A | | 6/1981 | Faubel et al. | |
| 4,495,044 A | * | 1/1985 | Banks | 204/192.11 |
| 4,728,851 A | | 3/1988 | Lambe | |
| 4,954,744 A | * | 9/1990 | Suzuki et al. | 313/336 |
| 5,675,216 A | * | 10/1997 | Kumar et al. | 313/495 |
| 5,773,921 A | | 6/1998 | Keesmann et al. | |
| 5,811,916 A | * | 9/1998 | Jin et al. | 313/310 |
| 5,936,608 A | * | 8/1999 | Springer | 315/169.3 |
| 6,097,138 A | | 8/2000 | Nakamoto | |
| 6,239,547 B1 | | 5/2001 | Uemura et al. | |
| 6,265,466 B1 | | 7/2001 | Glatkowski et al. | |
| 6,359,383 B1 | | 3/2002 | Chuang et al. | |
| 6,380,671 B1 | | 4/2002 | Lee | |
| 6,573,643 B1 | * | 6/2003 | Kumar et al. | 313/309 |

FOREIGN PATENT DOCUMENTS

| | | |
|---|---|---|
| EP | 0 905 737 A1 | 3/1999 |
| EP | 0 913 508 A2 | 5/1999 |
| EP | 0 951 047 A2 | 10/1999 |
| JP | 58-216327 | 2/1994 |
| JP | 10-050240 | 2/1998 |
| JP | 9-221309 | 6/1998 |
| JP | 10-199398 | 7/1998 |
| JP | 11-111161 | 4/1999 |
| JP | 11-135042 | 5/1999 |
| JP | 11-260244 | 9/1999 |
| JP | 11-260249 | 9/1999 |
| JP | 11-297245 | 10/1999 |
| JP | 11-329311 | 11/1999 |
| JP | 11-329312 | 11/1999 |
| WO | WO 98/21736 | 5/1998 |

* cited by examiner

*Primary Examiner*—Joseph Williams
(74) *Attorney, Agent, or Firm*—Kelly K. Kordzik; Winstead Sechrest & Minick P.C.

(57) ABSTRACT

A field emission cold cathode utilizes a film of carbon flake field emitters deposited thereon. The carbon flakes may exhibit rolled edges, but are still sufficient to provide improved field emission characteristics. A cold cathode using such carbon flake field emitters can be utilized to produce afield emission flat panel display, which can be implemented for use with a computer system.

24 Claims, 4 Drawing Sheets

CARBON FLAKE COLD CATHODE

TECHNICAL FIELD

The present invention relates in general to field emission devices and in particular, to cold cathodes used in field emission devices.

BACKGROUND INFORMATION

Carbon flake is a carbon material with a graphitic structure. It can be as thin as one or more layers of $sp^2$-bonded carbon atoms (graphite layers), and can be very long in two other dimensions. The length of a flake can be on the order of microns, whereas the thickness is on the order of nanometer or tens of nanometers. Thus, the aspect ratio for this material is very high. A flake, by its nature, is a system of ordered or turbostratic graphite layers. Carbon flakes fall into a class of nanostructured carbon materials. The flakes can be grown by several methods that fall into the following categories:

1. DC Glow Discharge. This method involves a direct current glow discharge between two electrodes in a gas environment. The plasma between the two electrodes is of the order of 1000° C. or higher. This method produces carbon flakes along with other types of carbon materials such as carbon nanotubes. This method is used for depositing directly onto a substrate.
2. Thermal CVD (Chemical Vapor Deposition) Method. In this method, a carbon precursor gas and a substrate are heated to a temperature of 600° C. and higher while thermal decomposition of the precursor is observed. The substrate has a catalyst on the working surface, which gives rise to growing carbon structures like carbon nanotubes and carbon flakes. A bias voltage can be used to make carbon nanostructures grow straight. This method is used for depositing directly onto a substrate.

Carbon nanostructures are believed to be good field emitters due to their chemical stability, sufficient electric conductivity, and low value of electron affinity. Carbon nanostructures fall into two categories with respect to their phase composition and morphology, namely, carbon films with low electron affinity, and those with a high aspect ratio:

1. Diamond films, diamond-like films, and nanocrystalline diamond fall into the first category where the low or negative values of electron affinity are essential, as described in F. J. Himspel, J. A. Knapp, et al. Phys. Rev. B, vol. 20, p. 624, 1979.
2. Carbon nanotubes and filaments fall into the second category where high values of electric field enhancement factors are essential.

These two groups of carbon materials specify two different approaches to making low-field carbon cold cathodes. Cold cathode materials from the second category are proven to have better field emission performance than those materials from the first category. The general problem with these materials is that the field emission properties of these carbon nanostructures are not always good.

The films from the first category have a rather poor defect-induced conductivity and low field enhancement factors, and, hence, lower density of emission sites and higher extraction fields. Along with susceptibility to ion bombardment, these films are sensitive to a chemical nature of bombarding species since the adsorbed atoms can significantly increase the electron affinity of these materials.

The films from the second category are also susceptible to degradation of the sharp tips of the carbon fibers and nanotubes. The increase of ultimate emission current requires higher density of nanotubes. However, too densely packaged nanotubes or nanofibers need higher extraction fields due to the screening effect that lowers the local electric field near the tips. Electrostatic calculations show that the optimal distance between the nanotubes should be on the order of the nanotube average height (See L. Nilsson, O. Groening, C. Emmenegger, O. Kuettel, E. Schaller, L. Schlapbach, H. Kind, J. M. Bonard, K. Kern, Applied Physics Letters, vol. 76, p. 2071, 10, Apr. 2000). These materials have higher electron affinity due to the graphitic nature of the carbon that they are formed of.

The problems with these materials lead to arcing and poor operation of field emission devices. One wishes to obtain good-performance cold cathodes that are robust, considerably less susceptible to ion bombardment, have high aspect ratio, and chemically inert.

SUMMARY OF THE INVENTION

The present invention addresses the foregoing needs by providing a carbon flake field emitter that is grown by a plasma-assisted chemical vapor deposition method on a semiconductor or metal substrate. A mixture of hydrogen ($H_2$) and methane ($CH_4$) (or other hydrocarbon gasses or liquids) is used as a carbon precursor. The substrate is heated to a high temperature above 600 C so that decomposition of carbon containing gas species occurs near the surface of the substrate.

The average distance between the emitting edges of the flakes is on the order of their size, which provides optimal field emission conditions.

Carbon flakes preferably originate from an interfacial layer of carbon material initially formed on the substrate at the beginning of the deposition. Since it is a carbon-to-carbon chemical bonding, the flakes have good adhesion to this layer.

Carbon flake field emitters differ from the other carbon-based cold cathodes in the following:

1. Better electric conductivity since the carbon flakes have a graphitic structure. As well as in graphite, the conductivity along the basal plane of the flake is almost metallic.
2. More robust than nanofibers since they are a two-dimensional structure rather than one-dimensional like the materials from the second category.
3. An increasingly extended emission area over the flake edge that enables higher emission currents.
4. Less susceptible to spoiling the field enhancement factor since this factor is a square root function of a length-to-thickness ratio for edge emission unlike a linear function of this ratio for tip emission from carbon fibers and nanotubes.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
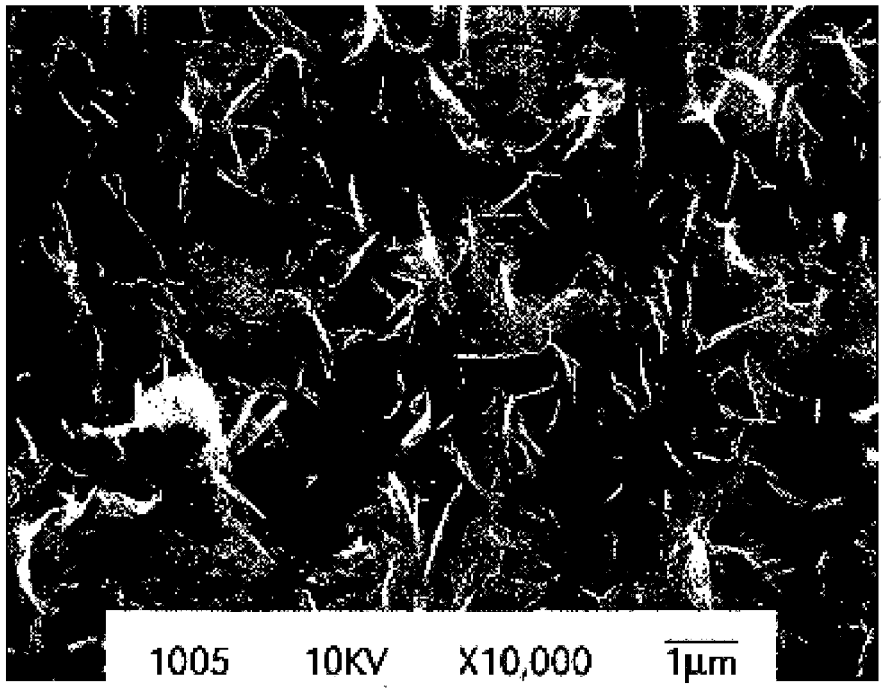
FIG. 1 illustrates an SEM image of a carbon flake field emitter.

In the following description, numerous specific details are set forth such as display configurations, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Figure 4:
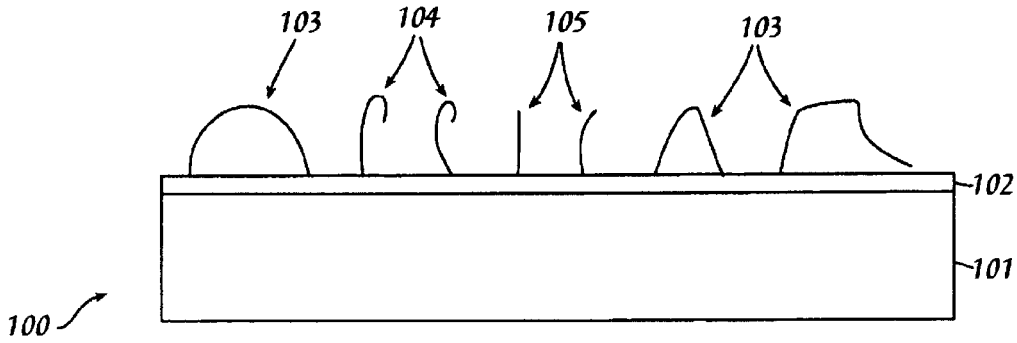
FIG. 4 illustrates a cathode utilizing carbon flakes in accordance with the present invention.

Referring to FIG. 4, there is illustrated a cold cathode configured in accordance with the present invention. A substrate 101 has a conductor material 102 deposited thereon. Then carbon flakes 103–105 are grown on top of the conductor material 102. The carbon flake field emitters 103–105 can be grown by a plasma-assisted chemical vapor deposition ("CVD") method using a mixture of hydrogen ($H_2$) and methane ($CH_4$) or other hydrocarbon gas as a carbon precursor. The substrate 102 has a temperature of at least 400° C., and is heated by a heater, or by adjacent plasma, or by hot carbon containing gas. The substrate 102 is cooled if its temperature is too high to form the flakes 103–105. During decomposition of carbon containing gas, the carbon atoms, or bonded carbon atoms, or carbon radicals assemble and form an $sp^2$-bonded carbon structure initiated on the substrate. The carbon radicals can further decompose leaving the carbon atoms bonded to the growing flake. The growth process occurs on the edges of the flakes 103–105 provided that flake is growing in lateral dimensions as new carbon atoms are bonded. This carbon structure 103–105 comprises the layers of $sp^2$-bonded atoms of carbon. The layers can be stacked together to form thicker flakes. During decomposition, gas species other than carbon may incorporate as defects in carbon structure. Such defects, as well as intrinsic defects of carbon structure may cause irregularities in this structure and, in turn, cause the flake bending.

Note that in an alternative embodiment, the carbon flake emitters 103–105 can be grown directly onto a semiconductor or metal substrate. Such a substrate may also be comprised of a semi-metal. A morphology of the carbon flake film containing the carbon flake field emitters 103–105 is shown in FIG. 1.

Figure 2:
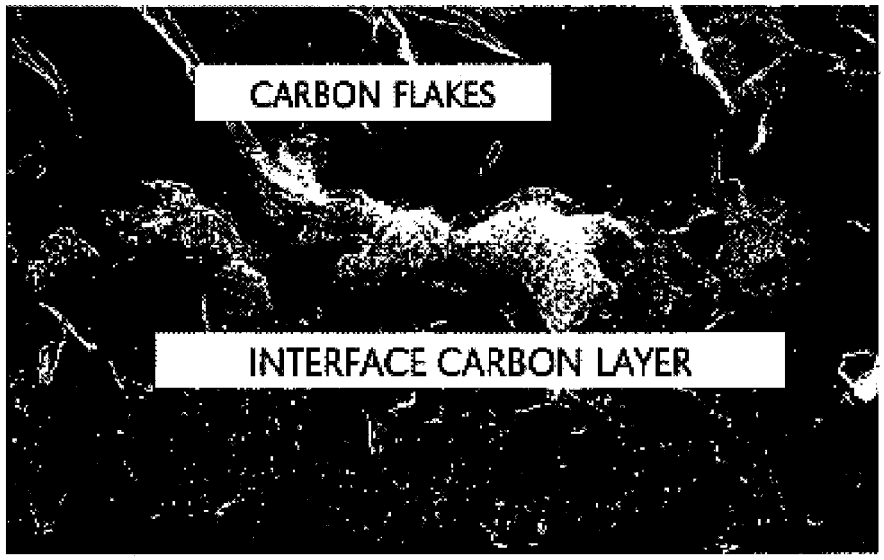
FIG. 2 illustrates an SEM image of an as-cleaved cross-section of a carbon flake field emitter.

The average distance between the emitting edges of the flakes is on the order of their size, which provides the optimal field emissions conditions. Carbon flakes preferably originate from an interfacial layer of carbon material initially formed on the substrate at the beginning of the deposition. Since it is a carbon-to-carbon chemical bonding, the flakes have good adhesion to this layer, as seen in the FEM image illustrated in FIG. 2.

Figure 3:
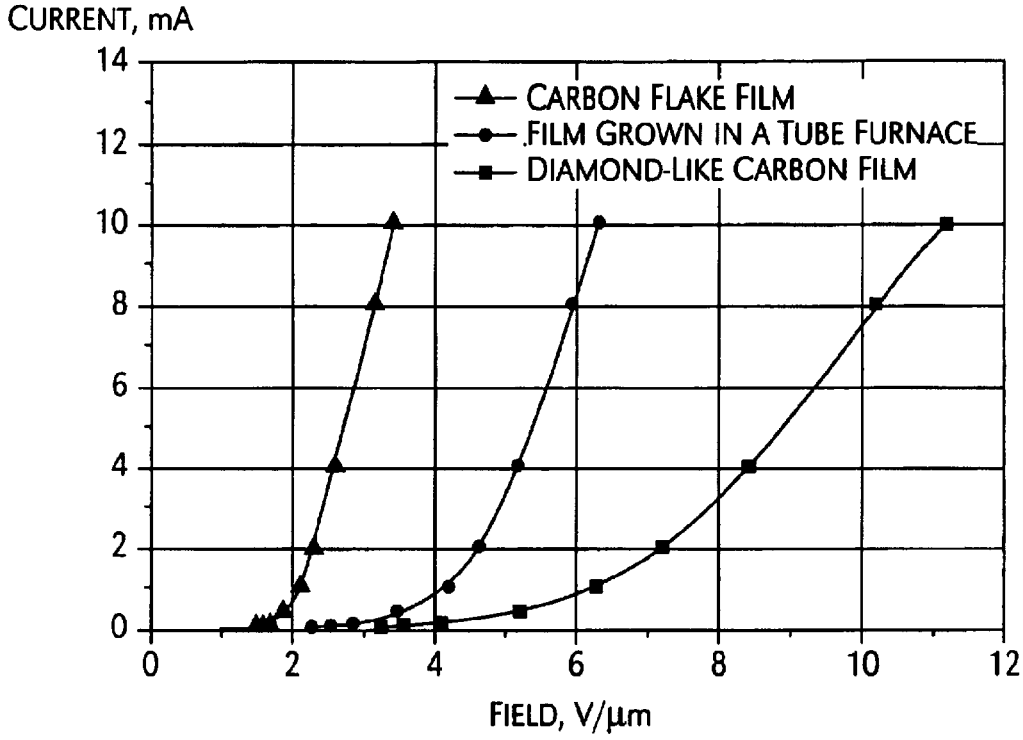
FIG. 3 illustrates a graph of a comparison of emission properties between different carbon emitters.

FIG. 3 illustrates the dramatically improved field emission characteristics of the carbon flake film as opposed to film grown in a tube furnace, and a diamond-like film.

Figure 5:
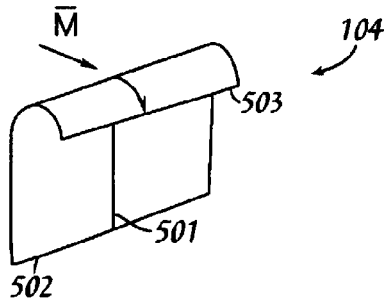
FIG. 5 illustrates one embodiment of a grown carbon flake.
Figure 6:
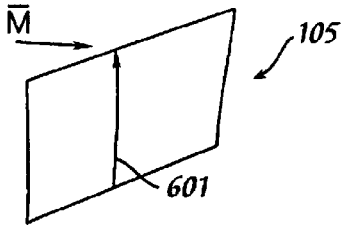
FIG. 6 illustrates another embodiment of a grown carbon flake.

Returning to FIG. 4, it is seen that the carbon flakes often have rolled edges as illustrated by carbon flakes 103 and 104. Carbon flakes 103 are rolled so significantly that they essentially form a loop on top of the substrate surface. FIGS. 5 and 6 further illustrate carbon flakes 104 and 105, respectively, which have less significant rolled edges as illustrated by the carbon flake 104 in FIG. 5, and almost no rolling of the edges as illustrated by carbon flake 105 in FIG. 6. Both FIGS. 5 and 6 further illustrate arrows 501 and 601 shown solely as lying along a surfaces of the carbon flakes from the base of the carbon flake at the substrate towards the edge of the carbon flake. The arrows designated with the director $\overline{M}$ are perpendicular to the arrows 501 and 506 at each point along such vectors. As can be seen in FIG. 5, when a carbon flake 104 has a rolled edge, the director $\overline{M}$ varies along the surface from the base 502 to the edge 503 thus resulting in the director $\overline{M}$ having a varying direction as it moves along the vector 501. Despite such rolled edges, such carbon flakes still exhibit very good field emission characteristics as evidenced in FIG. 3.

Figure 7:
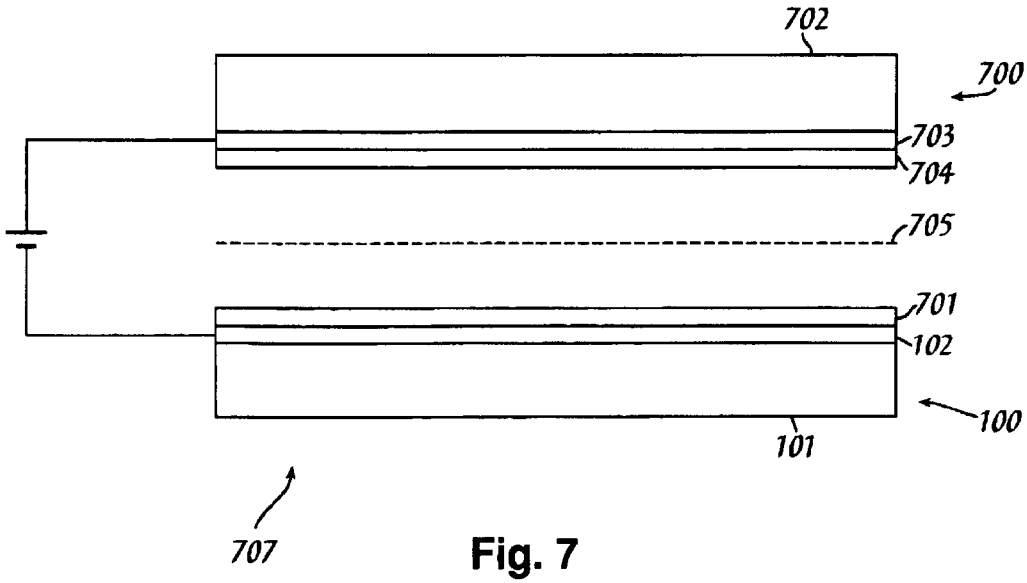
FIG. 7 illustrates a cross section of a display device configured in accordance with the present invention.

FIG. 7 illustrates a cross-section of a partial display device 707 using the cold cathode 100 illustrated in FIG. 4, where the layer of carbon flake film is designated by the numeral 701, which will contain carbon flakes 103–105. A predetermined distance away from the cold cathode 100, an anode 700 is positioned with a glass substrate 702, an indium tin oxide layer 703, and phosphor layer 704. A voltage bias is placed between the anode 700 and the cathode 100 to set up an electric field to cause the emission of electrons from the carbon flake from 701 towards the phosphor layer 704, so that it will result in the emission of protons through substrate 702 to form an image on the display 707. Note that one or more gate electrode 705 may also be utilized to enhance the field emission and switching characteristics of the display 707.

Figure 8:
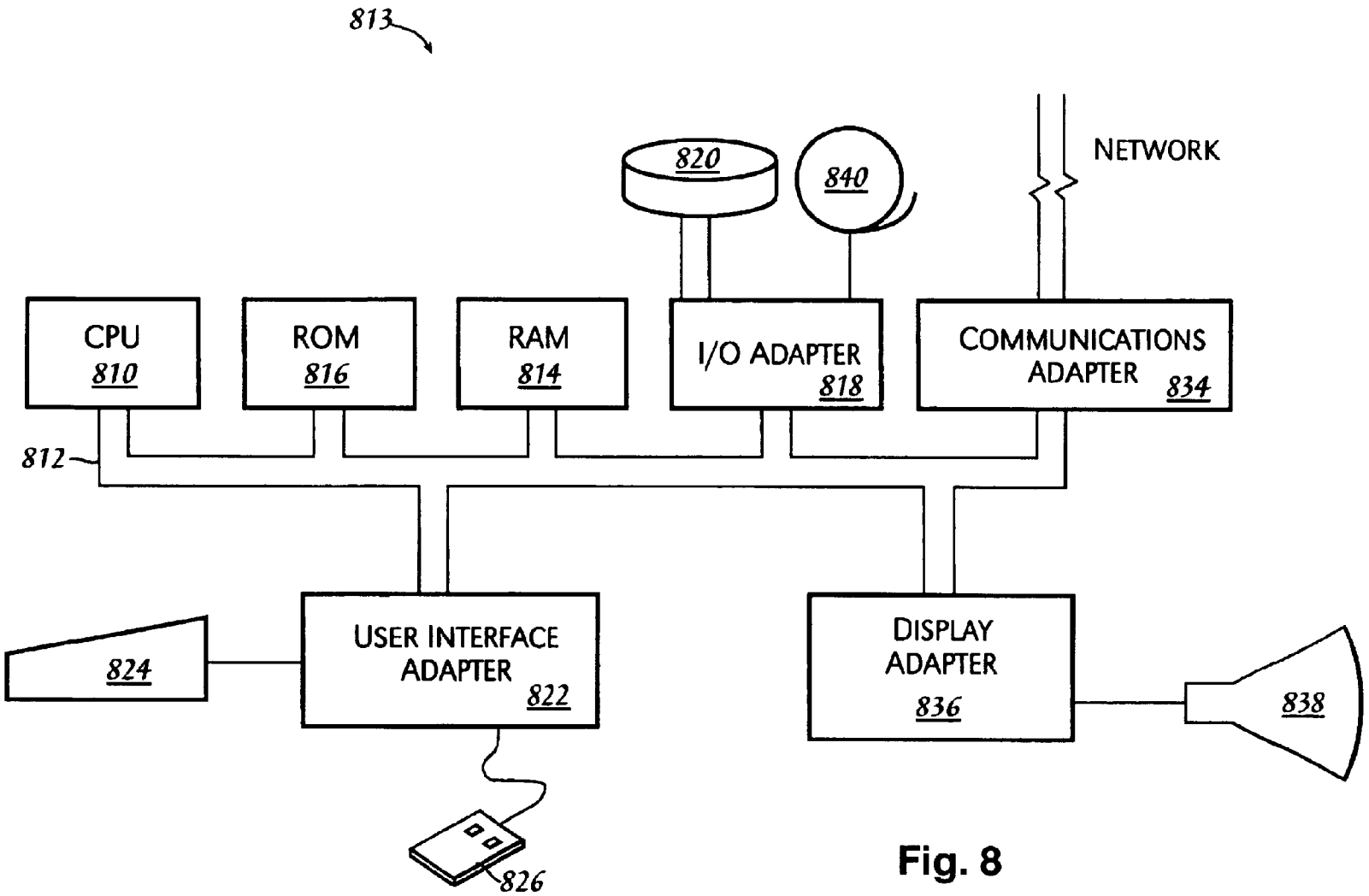
FIG. 8 illustrates a data processing system configured in accordance with the present invention.

A representative hardware environment for practicing the present invention is depicted in FIG. 8, which illustrates a typical hardware configuration of data processing system 813 in accordance with the subject invention having central processing unit (CPU) 810, such as a conventional microprocessor, and a number of other units interconnected via system bus 812. Data processing system 813 includes random access memory (RAM) 814, read only memory (ROM) 816, and input/output (I/O) adapter 818 for connecting peripheral devices such as disk units 820 and tape drives 840 to bus 812, user interface adapter 822 for connecting keyboard 824, mouse 826, and/or other user interface devices such as a touch screen device (not shown) to bus 812, communication adapter 834 for connecting data processing system 813 to a data processing network, and display adapter 836 for connecting bus 812 to display device 838. CPU 810 may include other circuitry not shown herein, which will include circuitry commonly found within a microprocessor, e.g., execution unit, bus interface unit, arithmetic logic unit, etc. CPU 810 may also reside on a single integrated circuit.

Although the present invention and its advantages have been described in detail, it should be understood that various changes, substitutions and alterations can be made herein without departing from the spirit and scope of the invention as defined by the appended claims.

What is claimed is:

1. An apparatus comprising:

a substrate;

a film of carbon flakes deposited on the substrate.

2. The apparatus as recited in claim 1, wherein at least one of the carbon flakes has a rolled edge.

3. The apparatus as recited in claim 2, wherein the at least one of the carbon flakes having the rolled edge exhibits a characteristic of a director varying along a surface of the at least one of the carbon flakes from a base to an edge.

4. The apparatus as recited in claim 3, wherein another one of the carbon flakes has a relatively straight configuration from base to edge.

5. The apparatus as recited in claim 1, wherein the carbon flakes have a relatively straight configuration from base to edge.

6. A cold cathode comprising:

a substrate;

a film of carbon flakes deposited on the substrate, wherein the film of carbon flakes is operable for emitting electrons under an influence of an electric field.

7. The cold cathode as recited in claim 6, wherein at least one of the carbon flakes has a rolled edge.

8. The cold cathode as recited in claim 7, wherein the at least one of the carbon flakes having the rolled edge exhibits a characteristic of a director varying along a surface of the at least one of the carbon flakes from a base to an edge.

9. The cold cathode as recited in claim 7, wherein another one of the carbon flakes has a relatively straight configuration from base to edge.

10. The cold cathode as recited in claim 8, wherein the substrate is made of a semiconductor material.

11. The cold cathode as recited in claim 8, wherein the substrate is made of a metal material.

12. The cold cathode as recited in claim 8, further comprising a conductor layer deposited between the film of carbon flakes and the substrate.

13. The cold cathode as recited in claim 6, wherein the carbon flakes have a relatively straight configuration from base to edge.

14. The cold cathode as recited in claim 8, wherein the substrate is made of a semi-metal.

15. The cold cathode as recited in claim 8, wherein the substrate is made of an insulating material.

16. A field emission display comprising:

an anode comprising a transparent substrate having a conductor layer and a phosphor layer deposited thereon;

a cathode comprising a substrate and a film of carbon flakes deposited on the substrate; and a voltage bias for creating an electric field between the anode and the cathode, wherein the film of carbon flakes is operable for emitting electrons under an influence of the electric field.

17. The field emission display as recited in claim 16, wherein at least one of the carbon flakes has a rolled edge.

18. The field emission display as recited in claim 17, wherein the at least one of the carbon flakes having the rolled edge exhibits a characteristic of a director varying along a surface of the at least one of the carbon flakes from a base to an edge.

19. The field emission display as recited in claim 17, wherein another one of the carbon flakes has a relatively straight configuration from base to edge.

20. The field emission display as recited in claim 16, wherein the substrate is made of a semiconductor material.

21. The field emission display as recited in claim 16, wherein the substrate is made of a metal material.

22. The field emission display as recited in claim 16, further comprising a conductor layer deposited between the film of carbon flakes and the substrate.

23. A data processing system comprising a processor coupled to an input device, an output device, a storage device, a memory device, and a display device by a bus system, wherein the display device further comprises:

an anode comprising a substrate having a conductor layer and a phosphor layer deposited thereon;

a cathode comprising a substrate and a film of carbon flakes deposited on the substrate; and a voltage bias for creating an electric field between the anode and the cathode, wherein the film of carbon flakes is operable for emitting electrons under an influence of the electric field.

24. The data processing system as recited in claim 23, wherein at least one of the carbon flakes has a rolled edge, wherein the at least one of the carbon flakes having the rolled edge exhibits a characteristic of a director varying along a surface of the at least one of the carbon flakes from a base to an edge.

* * * * *